US005961392A

United States Patent [19]

Hillock et al.

[11] Patent Number: 5,961,392

[45] Date of Patent: Oct. 5, 1999

[54] FOCUSED SWEET SPOT FOR ALL GOLF CLUBS

[76] Inventors: Bart A. Hillock; Terry J. Tyler, both of 911 Chapala St., Santa Barbara, Calif. 93101

[21] Appl. No.: 09/165,022

[22] Filed: Oct. 1, 1998

[51] Int. Cl.[6] ..... A63B 69/36

[52] U.S. Cl. ..... 473/236

[58] Field of Search ..... 473/236, 231

[56] References Cited

U.S. PATENT DOCUMENTS

| | | | |
|---|---|---|---|
| 3,437,341 | 4/1969 | Hasten et al. | 473/236 |
| 3,489,415 | 1/1970 | Smith | 473/236 X |
| 4,139,198 | 2/1979 | Kanavas | 473/236 |
| 4,323,246 | 4/1982 | Nehrbas | 473/236 |
| 5,351,961 | 10/1994 | Eulau | 273/186.2 |
| 5,524,895 | 6/1996 | Nakajima | 473/249 |

*Primary Examiner*—George J. Marlo
*Attorney, Agent, or Firm*—Terry J. Tyler; Bart A. Hillock

[57] ABSTRACT

A golf practice aid which uses a pressure-sensitive double-sided tape for removably attaching the aid to the club face of prior art club without noticeably changing the characteristics of the club. The practice aid preferably includes a metal base, which at its center has a circular ball striking platform which is raised from the base by means of a beveled edge and, at each end thereof, a raised, linear, triangular, alignment rail. When properly stroked with the club, the ball hits on the circular striking platform thereby causing the golf ball to go in a straight line in the direction of the target. When the golf ball is improperly stroked it strikes on the beveled edge surface and is turned away from the target.

1 Claim, 3 Drawing Sheets

FOCUSED SWEET SPOT FOR ALL GOLF CLUBS

BACKGROUND

1. Field of Invention

The instant invention relates generally to golf equipment and more specifically it relates to an attachment to the golf club's face for practice-use purposes.

2. Description of Prior Art

Numerous golf equipment have been provided in prior art that are adapted to assist golfers in gripping golf clubs, gauging or measuring distances and conditions, which might effect their play and in making strokes with the golf clubs. While these units may be suitable for the particular purpose to which they address, they would not be as suitable for purposes of the present invention as it is heretofore described.

In addition, these items have been lacking because they have not required the golfer to strike the ball in a narrow range.

U.S. Pat. No. 5,524,895 is a practice golf club putter comprising a grip to be held by the hands of a golfer. An elongated shaft extends from the grip. A putter head is provided having a convex striking surface. A facility is for securing a lower end of the shaft to the putter head. The convex striking surface of the putter head can stroke a golf ball, to make the golf ball roll in a straight line upon a putting green.

U.S. Pat. No. 5,351,961 is a removable golf putter alignment device for a golf putter of the type having a grip, a shaft, a neck, a head with a front face between a toe and a heel and a sole. The device is connected to the front face of the golf putter and includes a pair of curved extensions projecting forwardly and rearwardly from the golf putter with the rear extension having a pair of cross pieces for the purpose of spacing and rigidity and a single further rearward extension member to aid in sight alignment.

U.S. Pat. No. 5,275,570, a golf instructional aid device is provided which consists of a generally U-shaped flat frame having a V-shaped base with two parallel arms forming an open gate. The frame is secured to the turf, so that a golf ball can be placed upon the turf within the open gate between the arms. A structure on either of the arms is for allowing a golfer with a golf club to make a perfectly aligned stance, being a ball position and a hand position at address. The golfer can practice a golf swing at the golf ball, which will carry over to the play on the golf course when stroking the golf ball forward towards a hole.

U.S. Pat. No. 4,323,246 is a golf instructional aid and device which affixes to a golf putter for pratice purposes. The problem with this device is that its two-parallel bars which frame the hitting area require different widths for different skill levels and that is why it is sold as a set of three. In addition, its large rectangular shape does not fit on the face of some putters correctly.

OBJECTS AND ADVANTAGES

A primary object of the present invention is to provide a primary practice device which temporarily attaches to the face of the golf club that will overcome the short comings of the prior art devices.

Another object is to provide a smaller string surface, and reduce it to a raised platform with a beveled edge which requires the user to provide a more accurate golf stroke to achieve the desired result.

Another object of the invention is to provide the golfer with a visual aid to assist in aligning the ball properly on the club face prior to beginning the golf swing.

An additional object is to provide a focused sweet spot device which can be easily attached to any golf club.

A further object is to provide a focused sweet spot device which is simple and easy to use.

A still further object is to provide a focused sweet spot device that is economical in cost to the manufacturer.

Further objects of the invention will appear as the description proceeds.

To the accomplishment of the above and related objects, this invention may be embodied in the form illustrated in the accompanying drawings, attention being called to the fact, however, that the drawings are illustrative only, and that the changes may be made in the specific construction illustrated and described within the scope of the appended claims.

DRAWING FIGURES

Turning now descriptively to the drawings, in which similar reference characters demote similar elements throughout the several views.

Figure 1:
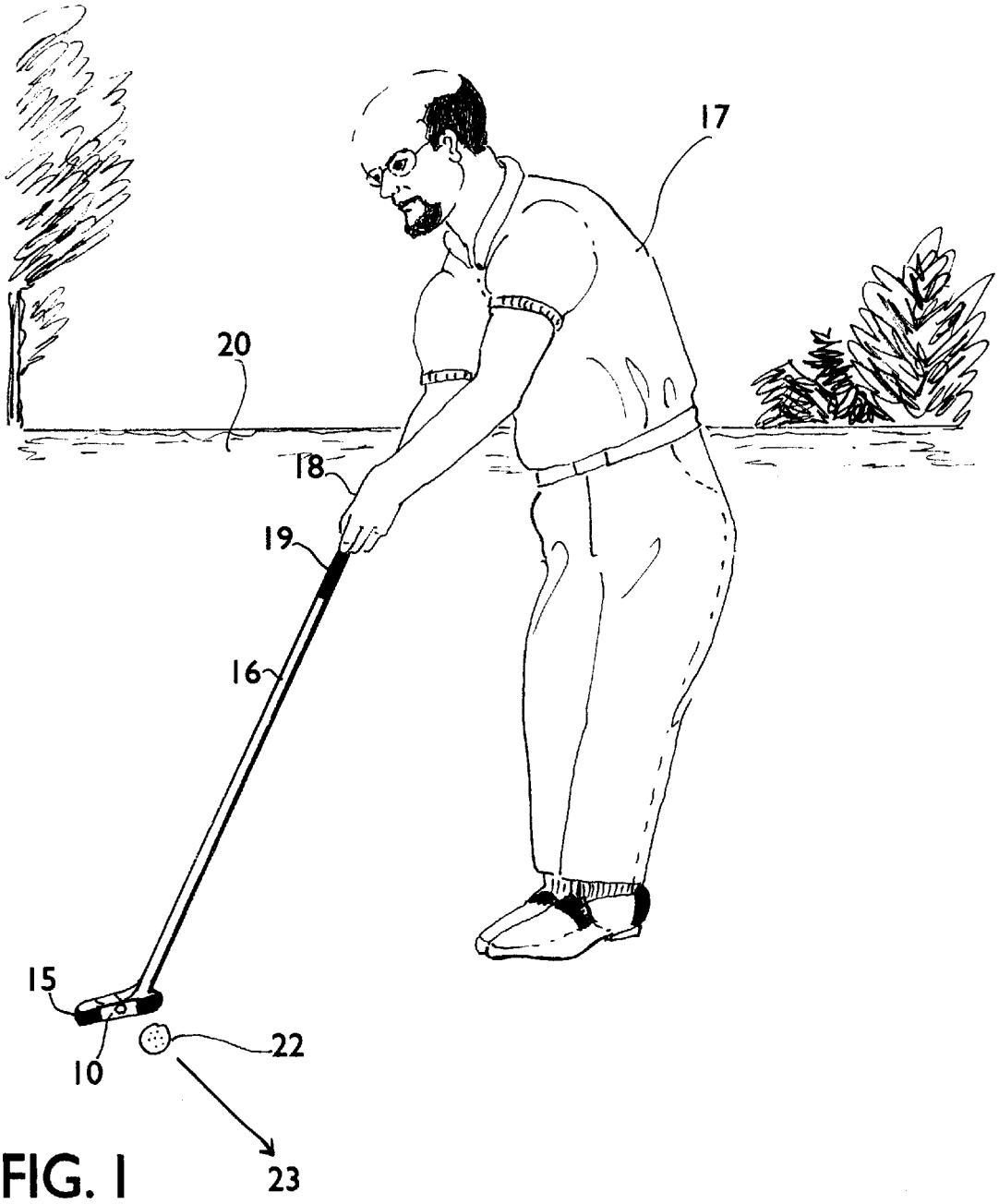
FIG. 1 is a perspective view showing the instant invention in use with a golf putter, being used by a golfer.

FIG. 1 illustrates the invention 10 in use attached to a golf putter head 15 with the putter in the grip 18 of a golfer 17, who is practicing putting on a putting green 20.

Figure 2:
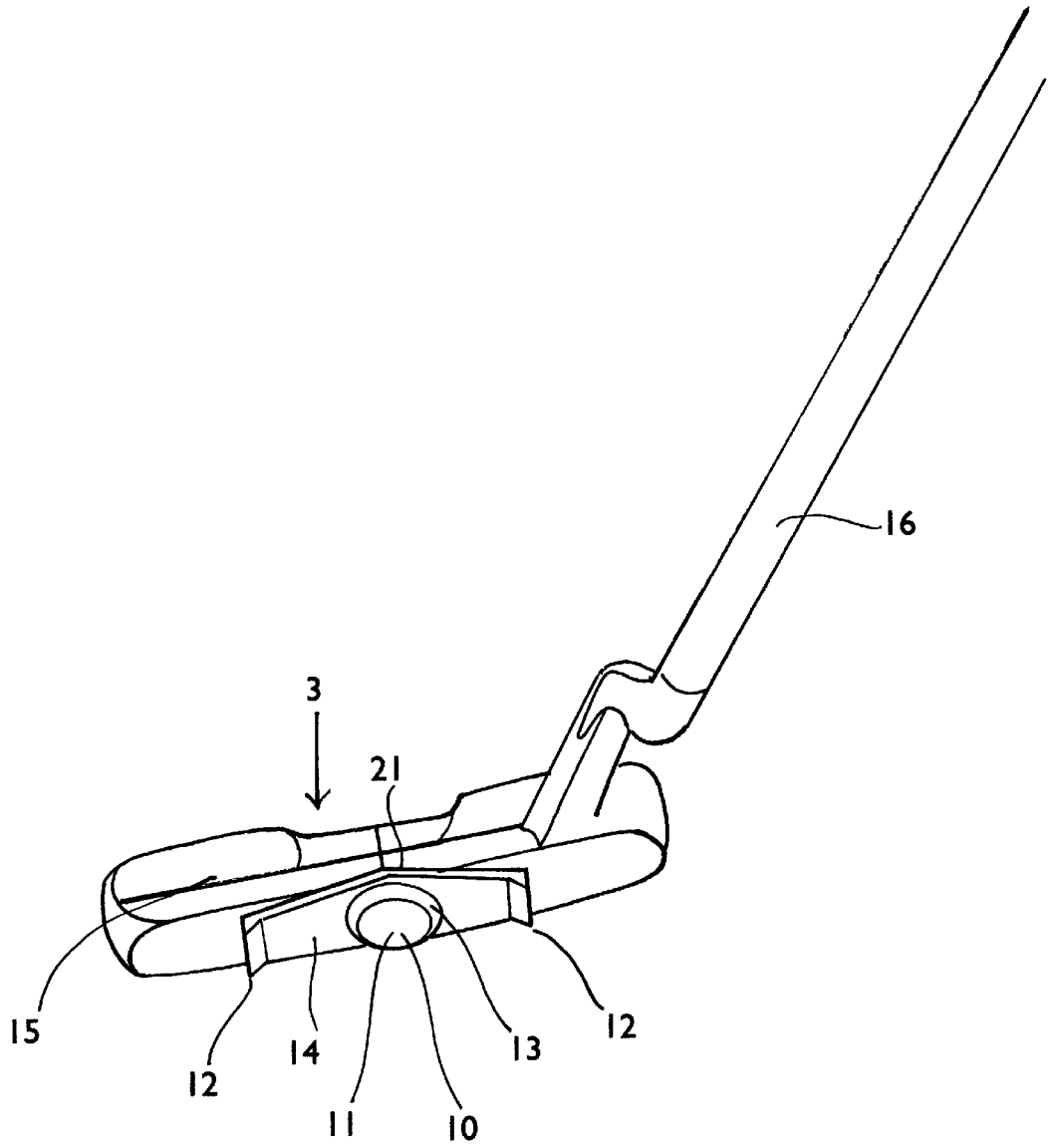
FIG. 2 is an enlarged perspective view as indicated by arrow 2 in FIG. 1, with the golfer removed therefrom.

FIG. 2 is an enlarged view of the putter shaft 16 and the golf putter head 15 with the focused sweet spot 10, attached by using two-sided adhesive tape 21 which is fabricated out of a metal material.

Figure 3:
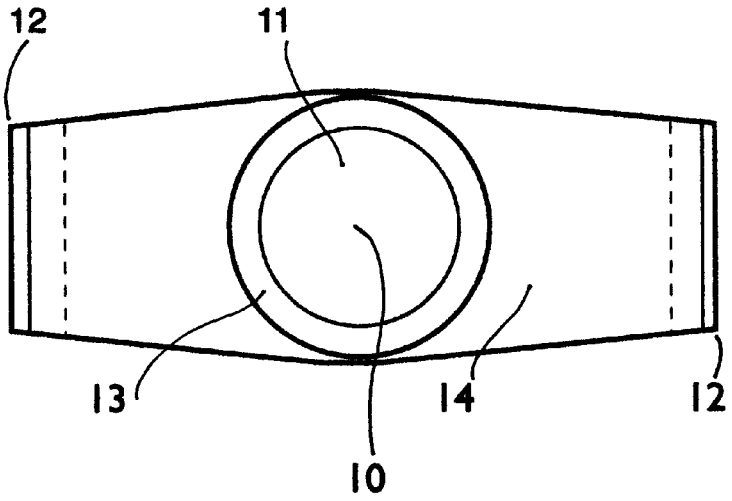
FIG. 3 is a front perspective view of the instant invention.

FIG. 3 is a front perspective of the focused sweet spot device 10 which shows the platform base 14, the linear alignment wings 12, the angled-beveled 11 of the raised striking platform 11.

Figure 4:
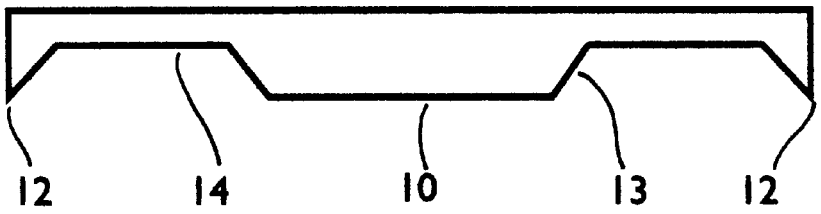
FIG. 4 is a top view indicated by arrow 3 in FIG. 2.

FIG. 4 is a top view of the focused sweet spot device 10 as it appears from the golfer's view looking down at the club. The raised striking platform's 10 reduced size becomes apparent when viewed at this angle, as does the beveled-edge 13 and the alignment wings 12.

Figure 5:
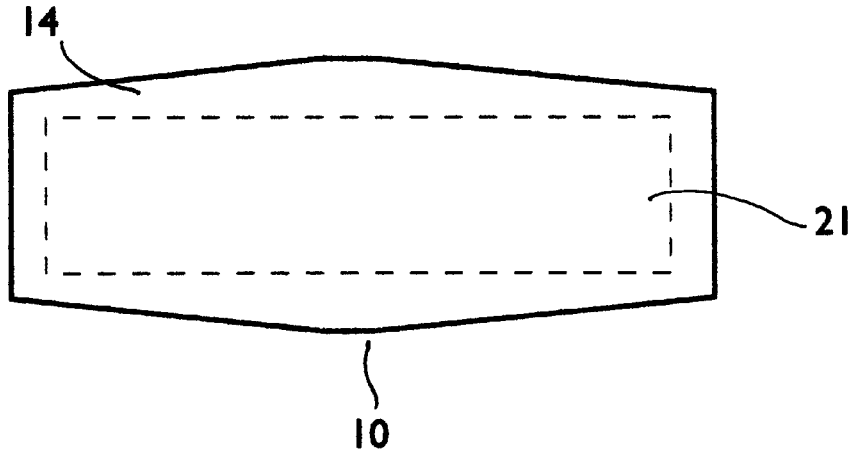
FIG. 5 is a back perspective of the instant invention detailed description of the preferred embodiments.

FIG. 5 shows the base side of the platform base 14, which is the surface that the two-sided adhesive tape 21 is attached to in order to affix the device to the golf club.

OPERATION OF THE INVENTION

To use the focused sweet spot 10, the following steps should be taken:

1. Attach the focused sweet spot 10 to the putter head 15, using the two-sided adhesive tape 21 making sure the sweet spot of the device is centered in the sweet spot of the putter head 15.

2. Grasp the grip 18 of the putter and align the putter head 15 and the focused sweet spot 10, specifically the raised striking platform 11 with the golf ball 22.

3. Pivot the grip 18 rearwardly so that the putter head 15 moves away from the golf ball 22.

4. Swing the grip 18 forwardly until the putter head 15 strikes the golf ball 22 on the raised striking platform 11 so that the golf ball 22 will travel in a straight line 23 on the putting green 20.

REFERENCE NUMERALS IN DRAWINGS

10. Focused sweet spot.
11. Raised striking platform.
12. Alignment wings.
13. Beveled-edge of striking platform.
14. Platform base.
15. Putter head.
16. Putter shaft.
17. Golfer.
18. Grip of 17.
19. Grip of Golf putter.
20. Putting green.
21. Two-sided adhesive tape.
22. Golf ball.
23. Straight line on 20.

SUMMARY

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

I claim:

1. A golf practice aid for removably attaching to the substantially flat striking surface of a club face normally used in playing a round of golf comprising a metal base, smaller than the golf club face, which at its center has a circular striking platform which is raised from the metal base by means of a 45 degree beveled edge, and at either end of the metal base are raised linear metal triangular rails which are critical in training for the proper alignment of the ball on the striking platform.

* * * * *